United States Patent [19]

Happe

[11] Patent Number: 4,848,037

[45] Date of Patent: Jul. 18, 1989

[54] DRYWALL SANDER MOUNT

[76] Inventor: Eugene E. Happe, 14725 Darmstadt Rd., Evansville, Ind. 47711

[21] Appl. No.: 202,690

[22] Filed: Jun. 6, 1988

[51] Int. Cl.[4] ..... B24B 23/00

[52] U.S. Cl. ..... 51/170 TL; 51/392; 15/144 A; 403/90; 403/114

[58] Field of Search ..... 51/170 R, 170 TL, 170 MT, 51/205 R, 392, 393; 15/144 A; 403/90, 113, 114

[56] References Cited

U.S. PATENT DOCUMENTS

| | | | |
|---|---|---|---|
| 2,753,669 | 7/1956 | Larson | 51/392 |
| 2,884,655 | 5/1959 | Maddox | 15/144 A |
| 3,123,946 | 3/1964 | Hoveland | 51/392 X |
| 4,516,361 | 5/1985 | Gringer | 51/392 |
| 4,663,796 | 5/1987 | Helling et al. | 15/144 A |

*Primary Examiner*—Robert P. Olszewski

*Attorney, Agent, or Firm*—Warren D. Flackbert

[57] ABSTRACT

A drywall sander mount which permits sanding action at a location remote from the person of the user, as on a ceiling or other high access location. The sanding mechanism is pole supported, where the mount permits universal movement during use. The basis of the mount is the provision of a connecting member having an enlarged end with flat opposite walls, where a pin secures the connecting member into position and permits sanding mechanism movement in the longitudinal axis direction of such and, as well, laterally.

4 Claims, 1 Drawing Sheet

DRYWALL SANDER MOUNT

As is known, sanding is an important element in achieving a top grade and/or professional drywall installation. The aforesaid sanding is typically accomplished in multi-stages and involves ceiling seams as well as seams in extended or high walls, each requiring the usage of ladders, scaffolds or the like to assure direct sanding contact. In addition to the accessibility factor, safety plays importance in achieving the desired finished surface.

The invention solves the preceding problems by presenting a specialized drywall sander mount and, more specifically, a pole sander which employes optimum pressure and universal movement during a use condition. The drywall sanding mechanism employed herein is electrically operated, where the mounting arrangement with respect to the pole affords a controlled sanding pattern although the operator is remote from the sanding surface. Typically, the invention is based on a common commercially available "jitterbug" form of sanding mechanism.

In any event, a better understanding of the present invention will become more apparent from the following description, taken in conjunction with the accompanying drawing, wherein

Figure 1:
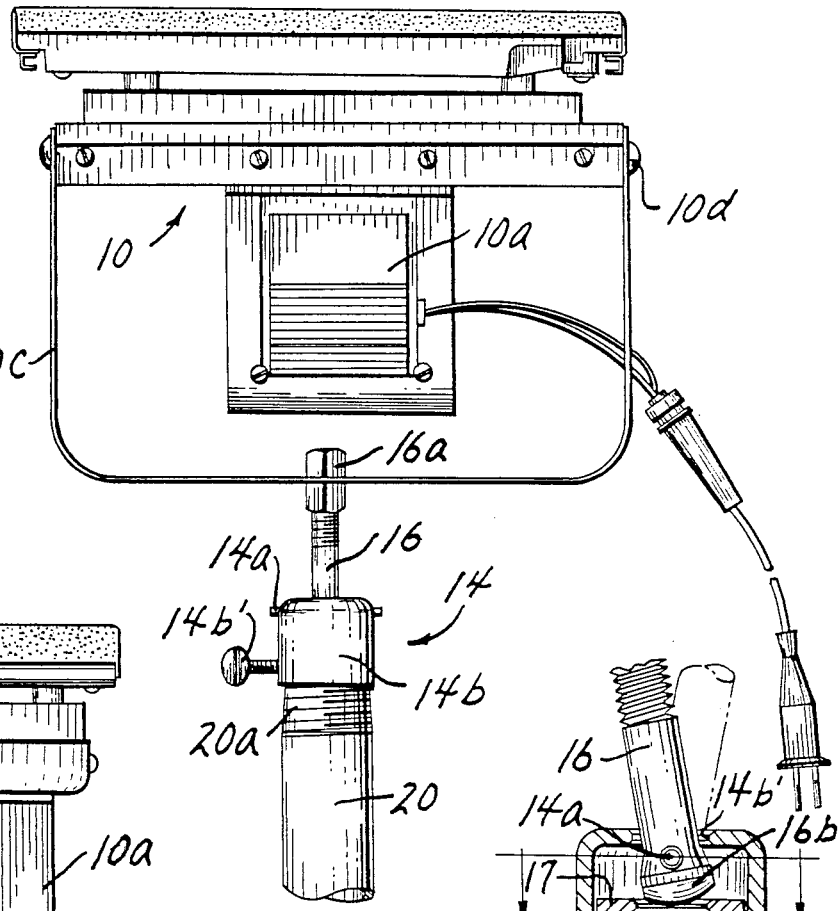
FIG. 1 is a view in side elevation, partly fragmentary, showing a drywall sander mount in accordance with the teachings of the present invention.
Figure 2:
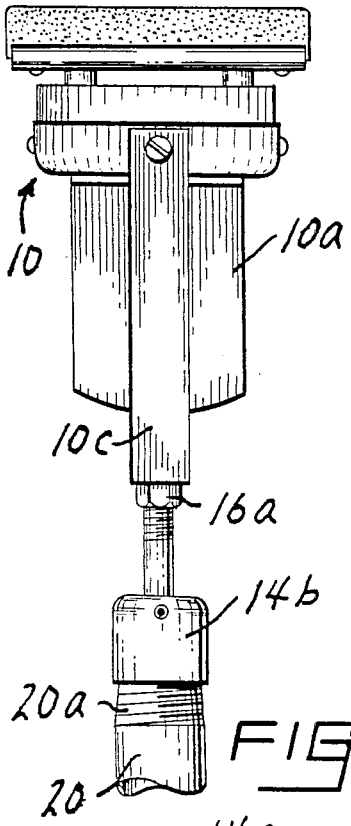
FIG. 2 is a view in side elevation of the drywall sander mount of FIG. 1, looking from right to left in such figure.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the drywall sander mount of the invention is characterized, broadly, as a conventional "jitterbug" sanding mechanism 10, driven by electric motor 10*a*, secured onto a strap 10*c*, by fasteners or screws 10*d*, which, in turn, is secured onto the end of a pole 20 by the mount arrangement 14 presented herein. The pole 20 can be of any length suitable for a particular use condition, serving ease in achieving sanding at a location remote from the person of the user.

The mount arrangement 14 of the invention achieves universal action between the hand-held pole 20 and the sanding mechanism 10. The preceding affords versatility, even though movement in a direction along the operational length of sanding mechanism 10 is more desirable than in the lateral direction so as to permit greater sanding passes along the seam line (not shown) and, thus, more effective use. In any event, a set pin 14*a* serves to positively control the amount of swivel and/or tension, where such action will be more fully described herebelow.

As is evident from the figures, the mount arrangement 14 herein includes a cover 14*b*, internally threaded so as to be received on the threaded end 20*a* of the pole 20. A set-screw 14*b'* serves in the fixed placement of the cover 14*b* on pole 20, where hand rotation of pole 20 achieves sanding mechanism 10 directional control.

Figure 3:
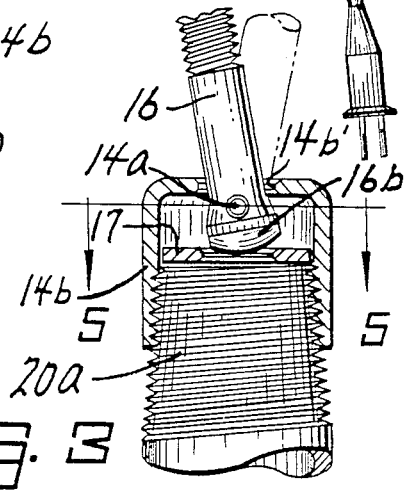
FIG. 3 is an enlarged view in vertical section, partly fragmentary and partly in phantom, detailing the mounting of the sanding mechanism on a support pole.
Figure 5:
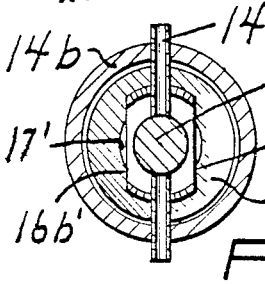
Figure 4:
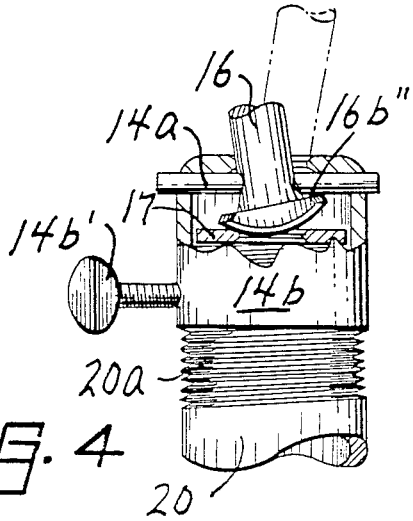
FIG. 4 is another view in an enlarged section, in this instance looking from right to left in FIG. 3, further detailing the mounting arrangement; and, FIG. 5 is a view in horizontal section, taken at line 5—5 on FIG. 3 and looking in the direction of the arrows, still further detailing the invention.

With particular reference to FIGS. 3, 4 and 5, an interconnecting member 16 extends from the strap 10*c*, to which it is secured by pairs of nuts 16*a*, through an opening 14*b'* in the top surface of the cover 14*b*. The bottom end 16*b* of the interconnecting member 16 is enlarged and seats within a centrally disposed opening 17' in a washer 17 or on the flat surface of a disc (not shown), where the latter is in engagement with a surface of end 20*a* of pole 20.

The assembly is completed by the aforesaid set pin 14*a* which extends through interconnecting member 16 near enlarged end 16*b* and through sides of the cover 14*b*. The set pin 14*a* limits the area of movement of the interconnecting member 16 and, hence, the sanding mechanism 10. While lateral movement is achievable (see FIG. 4), the predominant movement is in the longitudinal operational direction of the sanding mechanism 10 (orientation of the pole 20 is a use factor). In any event, the exact location of the set pin 14*a*, i.e. the receiving apertures for such in the cover 14*b* and in the interconnecting member 16, controls, as stated, tension and swivel.

Importantly, the bottom end 16*b* of the interconnecting member 16 is representative of a rounded bolt head from which opposite sides are cut to present flat surfaces or walls 16*b'* (see FIG. 5). As a result, the bottom end 16*b* has freedom of movement in the direction normal to the flat surfaces 16*b'*, but movement in the opposite direction is limited by the engagement of tips 16*b''* with the aforesaid set pin 14*a* (see FIG. 4).

As evident, therefore, the invention fulfills multi-purposes, to-wit, the provision of an electric sanding mechanism for drywall usage; seam sanding at a location remote from the operator, as on the end of a pole; and, a modified universal effect achievable by the mount per se, i.e. where longer sanding sweeps in the direction of the seam line may be accomplished and, as well, movement laterally of the seam.

The drywall sander mount described hereabove is susceptible to various changes within the spirit of the invention, including, by way of example, the particular sanding mechanism employed; the attachment of the interconnecting member to the sanding mechanism; the manner of securing the cover at the end of the pole; and, the like. Thus, the preceding should be considered illustrative and not as limiting the scope of the following claims.

I claim:

1. A mounting arrangement interconnecting a sanding mechanism and a pole comprising a cover threadedly disposed at an end of said pole, said cover including an opening, an interconnecting member having one end connecting said sanding mechanism and another end extending through said opening and within said cover, a member disposed within said cover and seating said another end of said interconnecting member at the central region thereof, said another end of said interconnecting member being rounded and presenting generally parallel spaced-apart flat side walls, and a pin ext extending through said interconnecting member and said cover in a swivel control relationship, where said interconnecting member and said sanding mechanism are readily movable in a direction normal to said flat side walls on said another end and limitedly movable in the direction of the longitudinal axis of said pin, and where selective tightening of said cover onto said member and said pole controls pressure on said interconnecting member and limits the aforesaid directional movements.

2. The mounting arrangement of claim 1 where said pin extends through said interconnecting member proximate said another end.

3. The mounting arrangement of claim 1 where a control pin extending into said cover serves to maintain said cover at a preselected position on said pole.

4. The mounting arrangement of claim 1 wherein said sanding mechanism and said interconnecting member move simultaneously.

* * * * *